United States Patent [19]

Doyle et al.

[11] Patent Number: 4,595,894

[45] Date of Patent: Jun. 17, 1986

[54] GROUND FAULT CIRCUIT INTERRUPTING SYSTEM

[75] Inventors: Richard C. Doyle, Greenlawn; Lester Rivera, Brooklyn, both of N.Y.

[73] Assignee: Leviton Manufacturing Co., Inc., Little Neck, N.Y.

[21] Appl. No.: 716,991

[22] Filed: Apr. 1, 1985

Related U.S. Application Data

[63] Continuation-in-part of Ser. No. 558,262, Dec. 5, 1983, and a continuation-in-part of Ser. No. 431,982, Sep. 30, 1982, Pat. No. 4,518,945.

[51] Int. Cl.[4] ..... H01H 73/00; H01H 73/12; H01H 75/00; H01H 83/06

[52] U.S. Cl. ..... 335/18; 361/332; 361/43; 361/42; 335/6

[58] Field of Search ..... 335/18, 202, 6; 361/42, 361/353, 356, 357; 200/296, 297

[56] References Cited

U.S. PATENT DOCUMENTS

| | | | |
|---|---|---|---|
| 4,010,432 | 1/1977 | Klein et al. | 335/18 |
| 4,163,882 | 8/1979 | Baslow | 200/297 |
| 4,518,945 | 5/1985 | Doyle | 340/310 |

*Primary Examiner*—E. A. Goldberg
*Assistant Examiner*—Lincoln Donovan
*Attorney, Agent, or Firm*—Paul J. Sutton

[57] ABSTRACT

A switching system for interrupting an electrical circuit is described. This switch includes a number of preferred and other embodiments which have this as their goal, but which represents a number of distinctive and novel approaches to solving switching problems in the prior art. By way of example only, these approaches include provision of mounting strap which supports ground terminals while also serving as a magnetic circuitry conduit; a "banger" type arrangement which enables alternate making and breaking of a circuit; and a space-saving method for supporting the arrangement within a device or system able to be installed within a conventional receptacle box.

4 Claims, 10 Drawing Figures

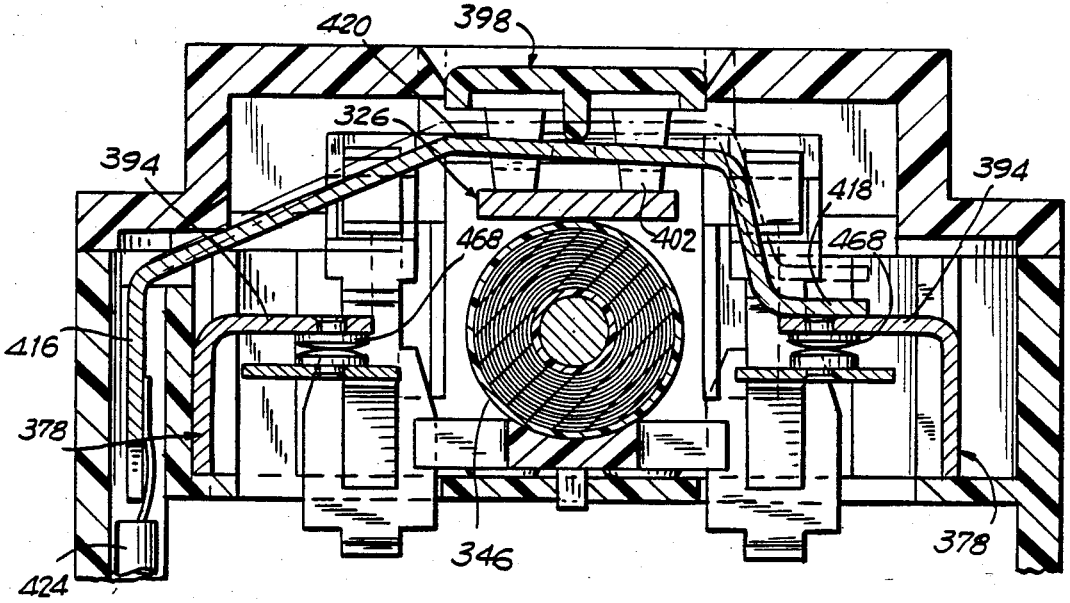
FIG. 4
FIG. 5
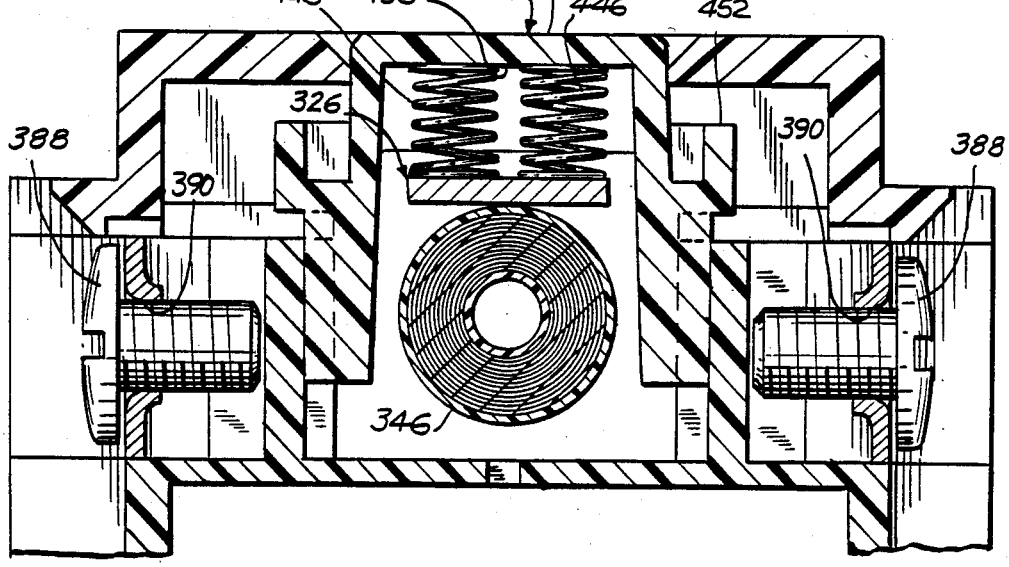

GROUND FAULT CIRCUIT INTERRUPTING SYSTEM

CONTINUATION-IN-PART APPLICATION

The present application is a continuation-in-part of applicants' both pending United States patent applications Ser. Nos. 431,982 now U.S. Pat. No. 4,518,945, filed Sept. 30, 1982 and entitled "REMOTE CONTROL SYSTEM" and Ser. No. 558,262 filed Dec. 5, 1983 and entitled "SHOCK HAZARD PRTECTION SYSTEM", and incorporates by reference as if fully set forth herein the entire contents and subject matter thereof and of any and all of their respective "parent" patent applications to which they are co-pending.

BACKGROUND AND SUMMARY OF THE INVENTION

What is referred to herein as a "second" preferred embodiment of the present invention simply is meant to denote another in a continuous series of technical developments relating, directly and indirectly, to the breaking or interruptions of circuits upon the existence of predetermined conditions. Because of this common thread that runs through these developments, the author hereof has chosen to group same within this continuation-in-part application, rather than file same in a separate and distinct patent application. This will also serve to aid the Examiner in considering, collectively, the prior art of record in all applications.

In addition to the advantages of the present invention already set forth in copending applications noted above, the contents of which are incorporated herein by reference, the second embodiment of this invention concentrates upon the ground fault circuit interrupting features of the invention. In other words, in use, should predetermined conditions exist, such as by way of example only, a threat to life or property as a result of what is known in the art as a "fault", the second embodiment of the present invention will cause an interruption of the circuit within which the fault appears, in a sufficiently short response time, so as to attempt to avoid injury or serious shock. No claim is being made within the present application for any possible novel circuitry or electrical means, but rather this application is directed to the novel electromechanical and mechanical means by which, in response to a signal, the circuit is interrupted by a physical separating of electrically conducting contacts.

In addition to other objects already set forth herein, it is, accordingly, an object of the second embodiment of the present invention to provide a dedicated ground fault circuit interrupting system within a device small enough to fit within a standard outlet or receptacle box or those of varying shapes and configurations.

It is a further object of the present invention to provide such a circuit interrupting system, in which same may function as an ordinary household electrical wall receptacle, while also providing protective features.

Another object of this embodiment resides in a novel operation of mechanical components in response to a predetermined signal, thereby opening or interrupting a circuit.

Still another object is to provide a ground fault circuit interrupting system which is shallower in depth than those previously marketed by the assignee in interest of this application, and which is relatively trip-free.

Another object of the present invention is to provide a circuit interrupting system which is less costly to produce and which has fewer component parts when compared to systems previously marketed by applicants' assignee in ineterest.

Yet another object is to provide such a system, in which a reset button and function is included.

Other objects will become apparent to the reader after a more detailed description of the present invention is set forth below, when read in conjunction to that set forth above. The following description concentrates upon FIGS. 1 through 10, inclusive, in which a ground fault circuit interrupter in the form of a duplex grounding receptacle is illustrated.

DESCRIPTION OF DRAWINGS

FIG. 4 is a sectional view taken along line 4—4 of FIG. 2.

FIG. 5 is a sectional view taken along line 5—5 of FIG. 2.

DESCRIPTION OF PREFERRED EMBODIMENTS

Figure 1:
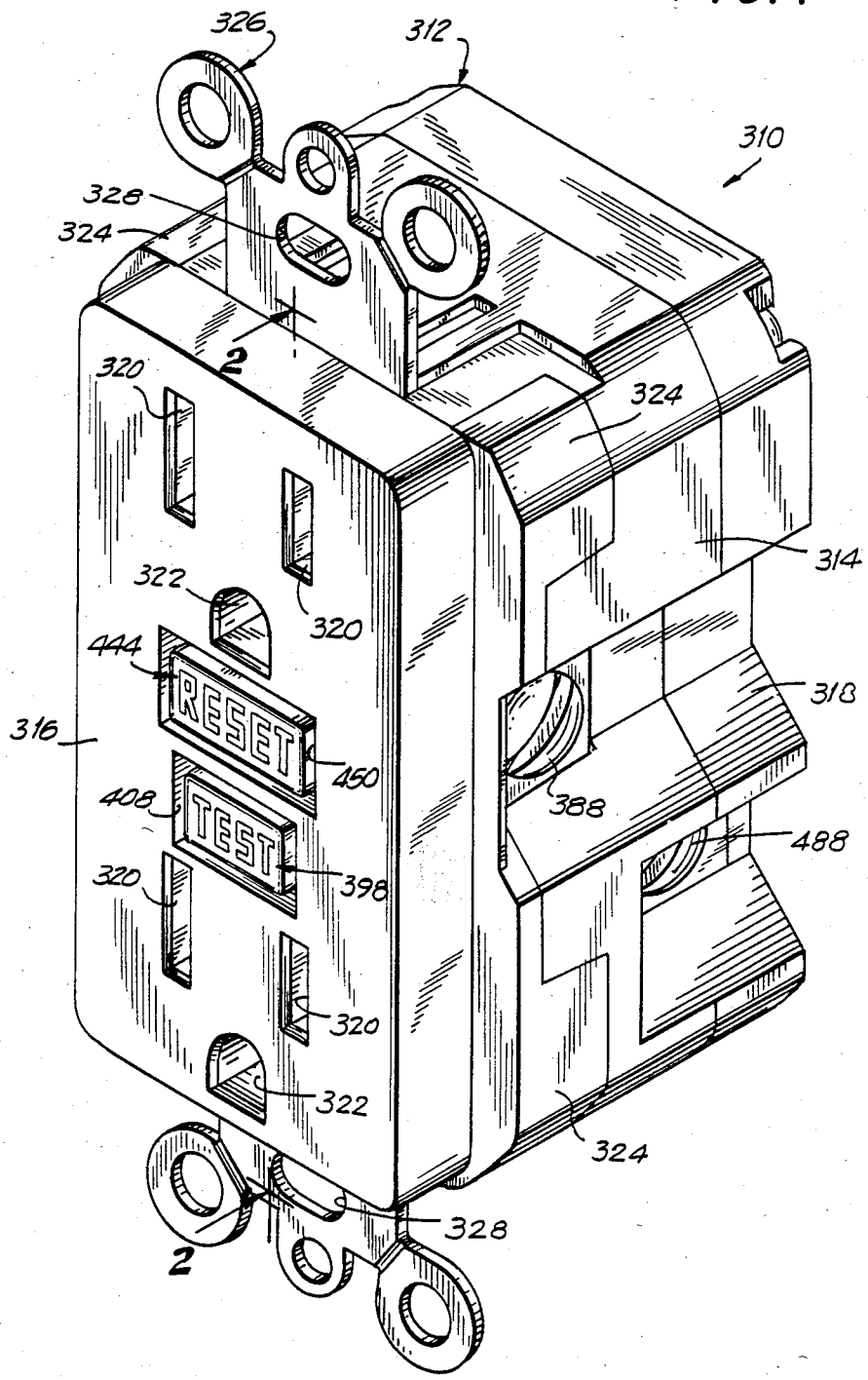
FIG. 1 is an upper right perspective view of a GFCI according to the present invention.

Referring to FIGS. 1–10, a circuit interrupting or switching system or apparatus 310 is shown as being made up of and consisting of a number of sub-assemblies and component parts. An effort in FIG. 10 has been made to assist the reader by illustrating many of these components in the form of an exploded view of an embodiment of this invention. A housing 312 holds the system in the form of a duplex receptacle, this housing consisting of a relatively central body or body portion 314 to which a face portion 316 and a rear portion 318 are removably secured.

Face or cover portion 316 is formed therethrough with entry ports 320 for receiving normal or polarized prongs of a male plug of the type normally found at the end of a lamp or appliance cord set (not shown), as well as ground-prong-receiving openings 322 to accommodate a three-wire plug.

Four housing shoulders 324 of face portion 316 nest with and engage body housing portion 313 during assembly of system 310. The shapes of shoulders 324 and their cooperative alignment with corresponding surfaces of central body portion 314 assure proper alignment of the entire assembly and the sub-assemblies and components contained therein.

Figure 2:
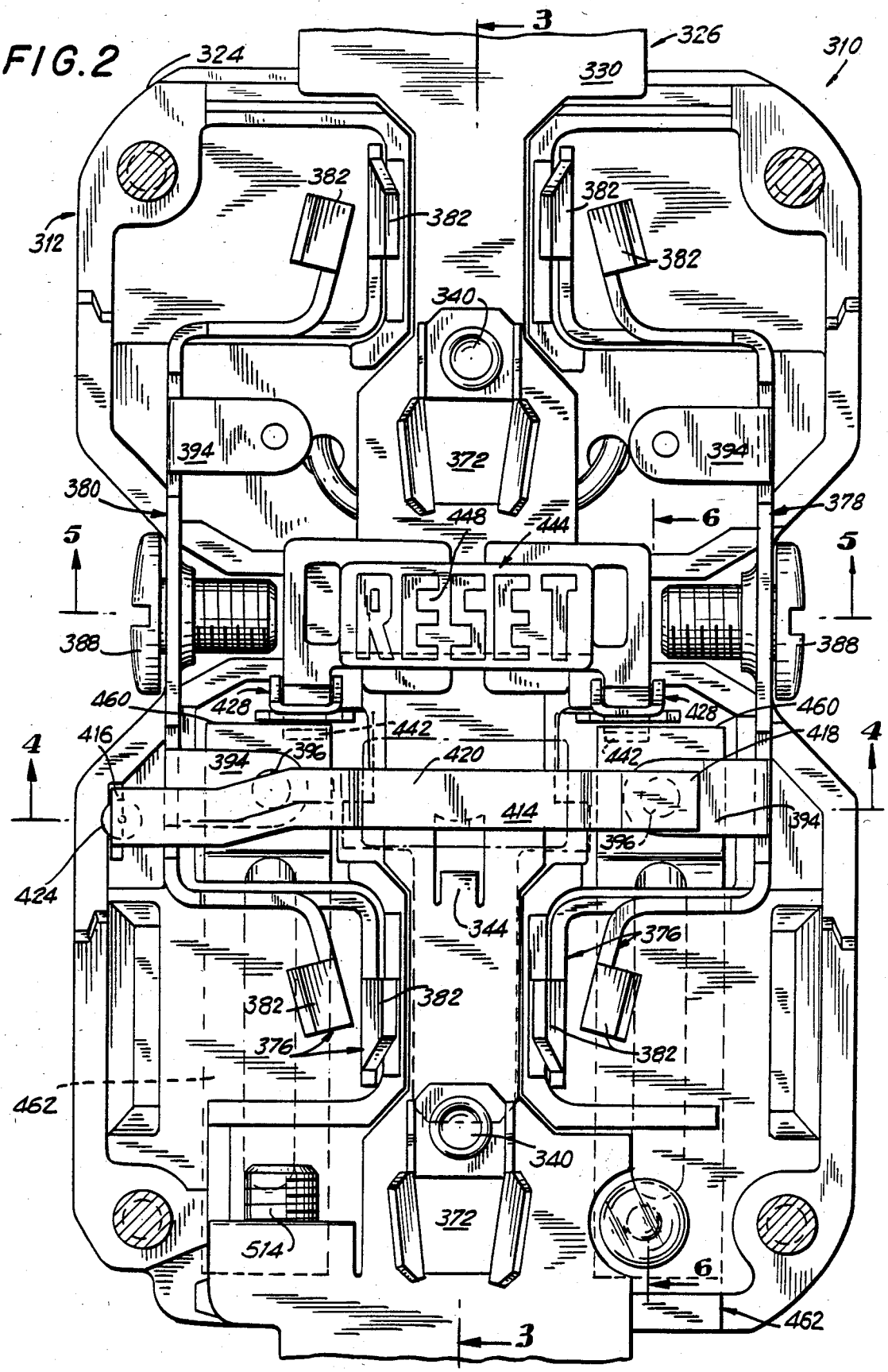
FIG. 2 is a sectional elevational view taken along line 2—2 of FIG. 1.

FIG. 2 may best be described as being a view of circuit interrupting system 310 with face housing portion 316 removed from central body housing portion 314. While this view does not reveal all of the critical components and features of this embodiment of the present invention, it serves to illustrate the position of mounting strap 326 with respect to its neighboring components. Mounting slots 328 are formed through remote ends of the strap to accommodate mounting screws (not shown).

Mounting strap 326 is formed with a pair of end tab portions 330 and 332, the latter, unlike the former, including a generally square opening 334 formed therethrough. A second relatively square opening 336 is formed through a relatively central central strap portion 338 of strap 326, each of these openings 334 and 336 being defined by surfaces of the strap which lie adjacent rivet posts 340 integrally formed with strap 326.

Figure 3:
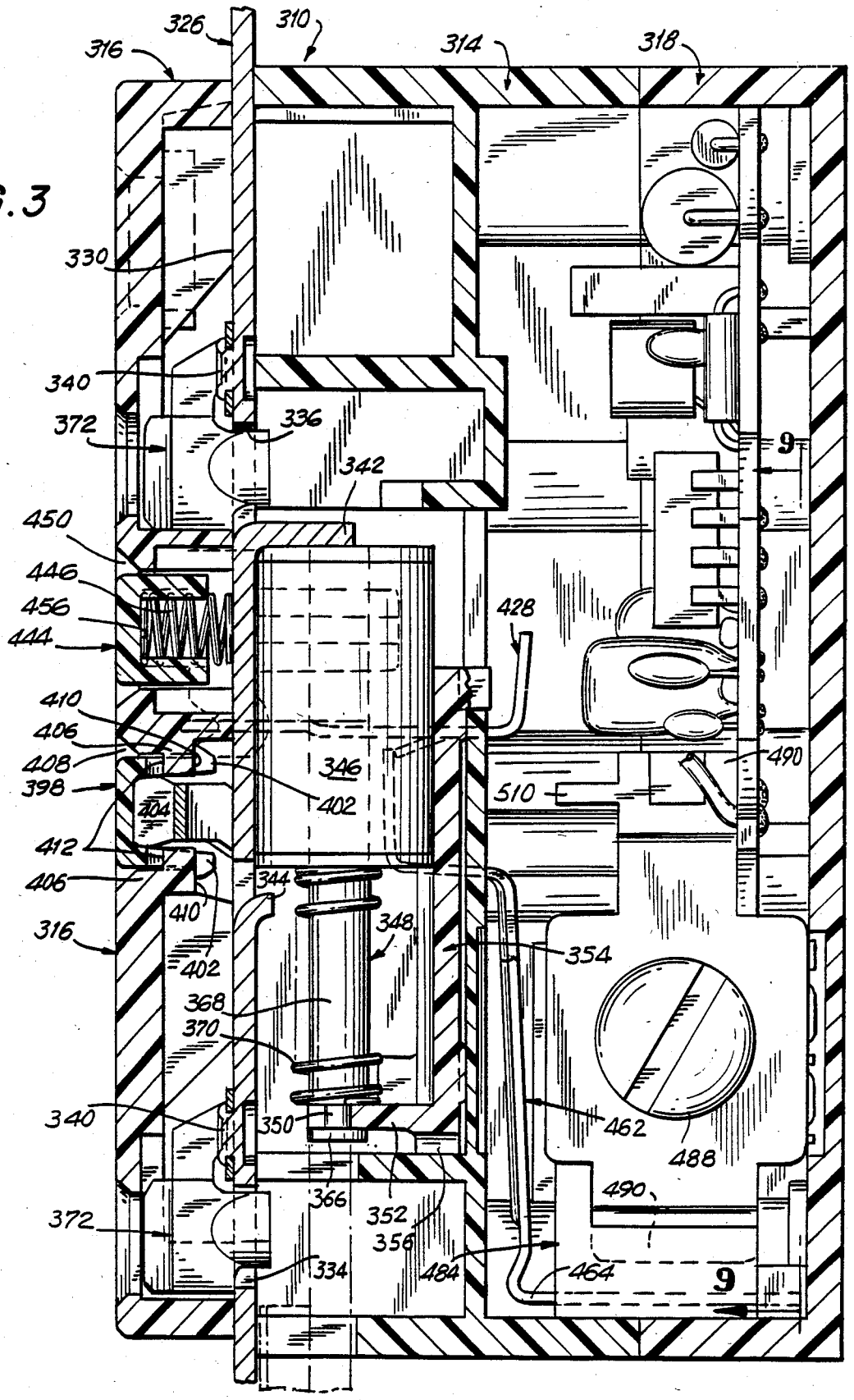
FIG. 3 is a sectional view taken along line 3—3 of FIG. 2.

As in the case of strap 22, mounting strap 326 is preferrably formed from steel sheet metal by means of a progressive die blanking and stamping and forming procedure, and further includes a pair of relatively depending tabs 342 and 344 located on opposite ends of coil assembly 346 (see FIG. 3 as well). Coil assembly 346 includes a plurality of conductor windings which generate and induce an electromagnetic field, the path of which extends through strap 326, as in the case of strap 22. This magnetic field influences the position of an armature or plunger 348, which responds to the energizing of coil assembly 346 by being drawn toward the center of the coil assembly in the manner of plunger 94. However, in the case of plunger 348, a lesser diameter neck 350 thereof cooperatively engages the yoke 352 of what the inventors hereof refer to as a "banger" member 354 which, in turn, extends between said yoke 352 near one end 356 thereof to an opposite end 358 adjacent which a pair of oppositely facing pairs of front and rear banger dogs 360 and 362, respectively, are situated within a relatively common plane. Dogs 360 and 362 are spaced from one another to define gaps 364.

The neck 350 of plunger 348 is defined by relatively greater diameter head and shank portions 366 and 368, respectively, which serve to keep or capture and hold plunger 348 integral with banger 354, such that movement of te plunger will result in like movement of the banger when the coil assembly 346 is energized.

A helical banger return spring 370 extends over plunger shank portion 368 such that its forward end abuts banger yoke 352 and its rearward end abuts coil assembly 346. Return spring 370 is maintained under slight compression with its opposite ends biased away from one another. Upon energization of coil assembly 346 and the resulting movement of plunger 348 and banger 354 toward the center of coil assembly 346, banger return spring 370 is compressed and exerts a biasing force tending to return the banger to the position shown in FIG. 3. The significance of this will be appreciated hereinbelow.

Rivet posts 340, integrally formed with their strap 326, are utilized to secure ground contacts 372 in physical and electrical continuity with the strap and thus the supporting structure to which the strap is secured by means of the mounting screws (not shown), via the male ground blade or terminal of a three-wired plug.

Having mentioned the ground contacts, the line or hot and neutral blades of a three-wire plug engage terminals 374 and 376 formed on terminal assemblies 378 and 380, respectively. Terminals 374 and 376 are formed by upstanding and angularly bent tabs 382 on each, resiliency being created by the combination of a combination of relatively cantilevered larger tabs 384 and 386 on each terminal assembly.

When system 310 is assembled and being installed, the user thereof is able to secure a conductor to the assembly by means of wire binding screws 388 which engage threads 390 formed in sides 392 of each assembly. These sides include as an integral part of each contact arms 394 extending perpendicularly and relatively inwardly therefrom. A silver contact 396 is secured to a contact arm 394 of terminal assembly 380. Contact 396 plays a role in a test function of system 310 as will now be explained.

Figure 10:
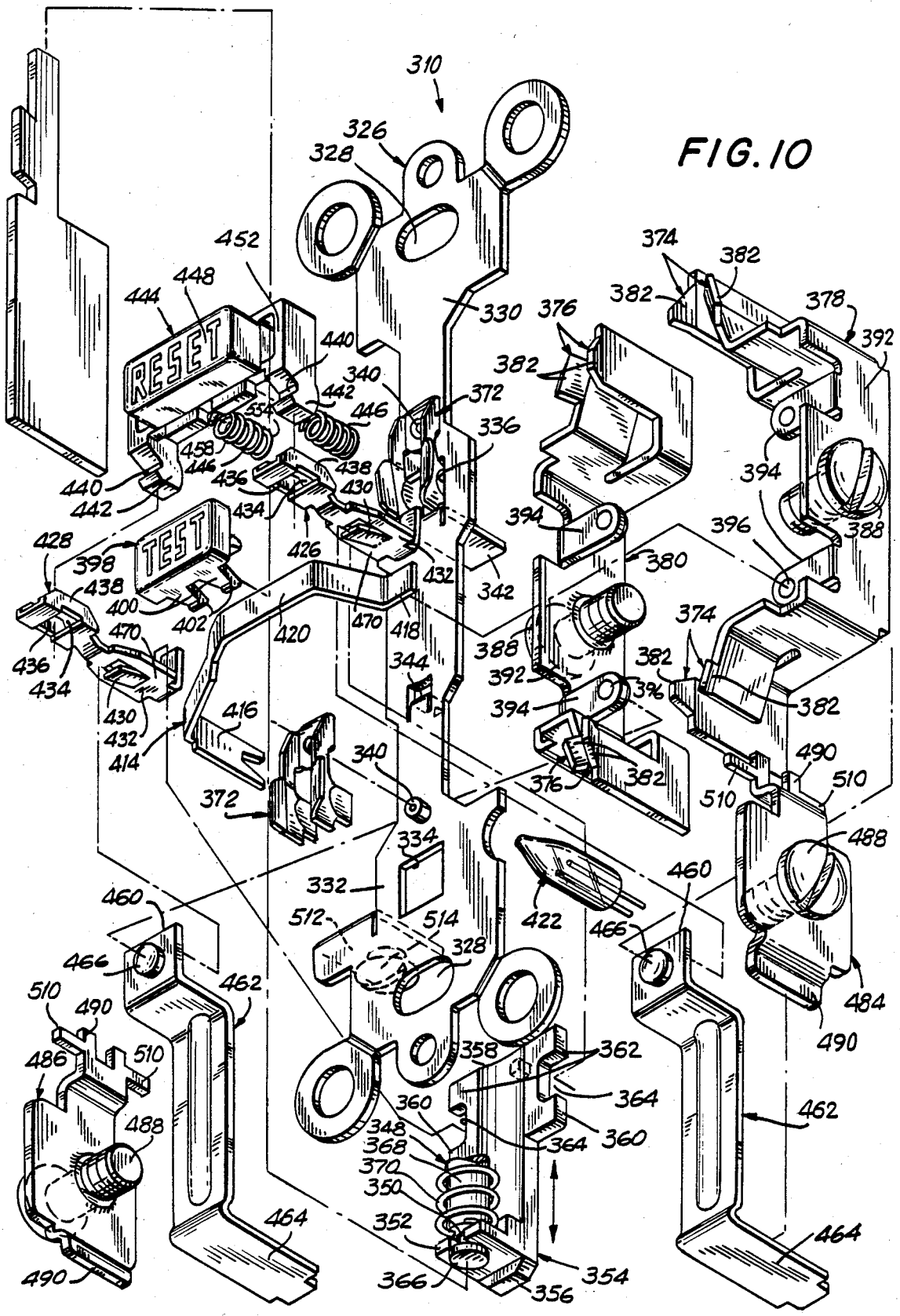
FIG. 10 is an exploded perspective view of the GFCI components.

A test button 398, shown in exploded view FIG. 10 is formed with resilient arms 400 with latching fingers 402 at the ends of each, and is further formed with a relatively central ridge 404 along the underside thereof. Latching fingers 402 enable the snap-in assembly of test button 398 from the outer side thereof into face housing portion 316. These fingers, as a result of resilient arms 400, are leaf-spring-type biased away from the center of test button 398 and, upon assembly, engage the walls 406 of test button 398 which define opening 408 until they pass ledges 410, whereupon they spring or snap outwardly to keep test button 398 from exiting the face portion 316. Shoulders 412 formed in face housing portion 316 are engaged by underside surfaces of test button 398, thereby keeping the button from further entering the system 310 when assembled.

A movable test switch blade 414 is formed in a generally arcuate shape with an anchor leg 416 at one end for fixing and holding within a recess formed in central body housing portion 314, wherein it is electrically connected within a test switch circuit, and with its opposite end terminating in a contact tab 418 which is movable between open and contact positions. Contact tab 418 is biased by means of the leaf-spring-type resiliency of blade 414 toward said open position, shown in broken lines in FIG. 4. Upon depression of test button 398 by the user, ridge 404 in contact with bearing surface 420 of test switch blade 414 forces the blade downwardly to the position shown in full lines in FIG. 4, wherein it can be seen that contact tab 418 is in engagement with silver contact 396, thereby closing a test circuit by forming a switch, and enabling the user of system 310 to see light emitting from bulb or diode 422 which is energized as part of the test circuit. A resistor 424, as part of this test circuit, is welded to anchor leg 416. Upon release of the test button, the same resiliency described above for test switch blade 414 biases and urges test button 398 upwardly so as to extend in a non-test position from face 316, ready for the next test depression. In this way, the user is able to see whether the device or system 310 is able to afford the protection intended. Users of ground fault circuit interrupters (GFCI's) purchase same for protection against hazardous electrical shock that may be caused if the body becomes a patch through which electricity travels to reach ground, for example, This may occur when one touches an appliance or cord that is "live" through faulty mechanism, damp or worn insulation, or other problems. System 310 "breaks" or interrupts the powered circuit by sensing a fault. How this is accomplished and how the breaker may be reset will now be described.

A pair of latching memebers 426 and 428 are shown in FIG. 10 in exploded view. Each of latching members 426 and 428 are formed with a latching finger 430 created by an angularly bent upwardly extending tab which extends out of the plane of face surface 432. At upper portions thereof, each of latching members 426 and 428 are formed with retainer openings 434 bounded at their top by edges 436. Rearwardly facing sides 438 are substantially parallel with respect to one another and, as in the case of latching fingers 430, are integrally formed by progressive die forming processes.

Latching members 426 and 428 are supported by upwardly facing surfaces 440 within forwardly facing fingers 442 are formed as part a reset button 444. Top edges 436 engage surfaces 440 for forward and rearward pivotal movement of the latching members about the edges 436 as fulcrum points. Reset springs 446, helically wound and in compression, bias the reset button 444 upwardly such that its protruding contact portion 448 extends through opening 450 formed in face housing portion 316, so as to be able to be repeatedly engaged by the user thereof. Shoulders 452 formed adjacent contact portion 448 engage the underside surfaces of face 316 so as to prevent the button's escape when assembled. Springs 446 are compressed between and engage strap 326 at their respective lower ends 454, and inner surfaces 456 of reset button 444 at their respective upper ends 458, thereby locating same as well.

Figure 8:
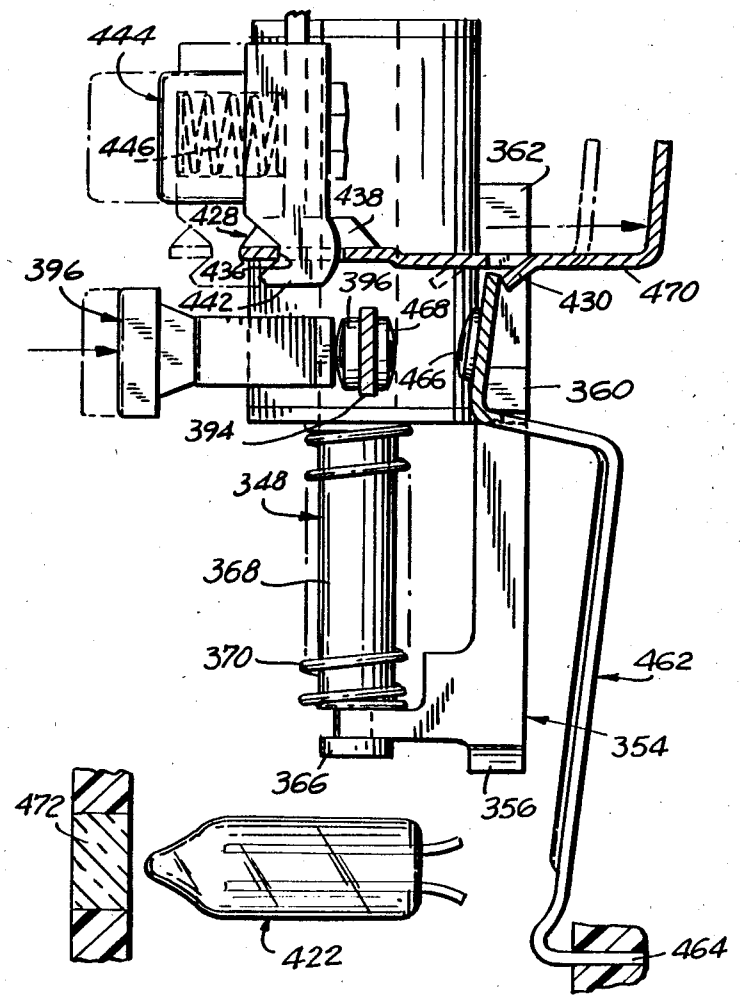
FIG. 8 is a sectional view taken along line 8—8 of FIG. 2.

Referring now to FIG. 8, it is illustrated therein that depressing reset button 444 will result in downward movement of latching members 426 and 428 such that their respective latching fingers 430 pass over and beneath the remote ends 460 of movable contact arms 462 against the upwardly biasing forces of springs 446. Movable contact arms 462 extend from ends 460 to opposite anchor ends 464 which, in turn, are secured by frictional anchoring, such as within a slot of predetermined shape and configuration. Arms 462 have secured thereto electrical contacts 466 at upper surfaces adjacent ends 460, as shown in FIG. 10. When anchored at ends 464, arms 462 and their ends 460 are biased as a result of their leaf-spring-type configuration downwardly as shown in FIG. 3.

Figure 6:
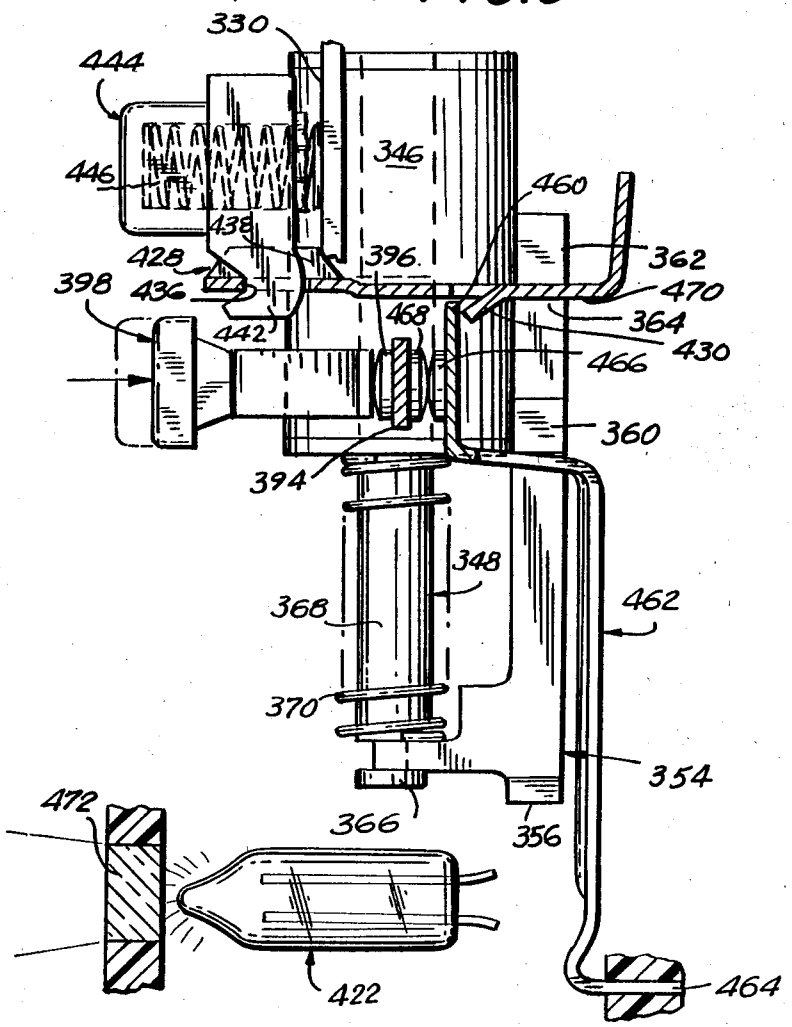

Upon release of the reset button after depression of same, latching members 426 and 428 and their respective fingers 430 engage the undersides of the remote ends 460 of movable contact arms 462, "lifting" same until movable contacts 466 come into physical and electrical engagement with fixed contacts 468 which are integral with and electrically continuous with contact arms 394 and silver contact 396, thereby completing or "making" a circuit. This is illustrated in part within FIG. 6, illustrating the status of system 310 after release of the reset button.

Figure 7:
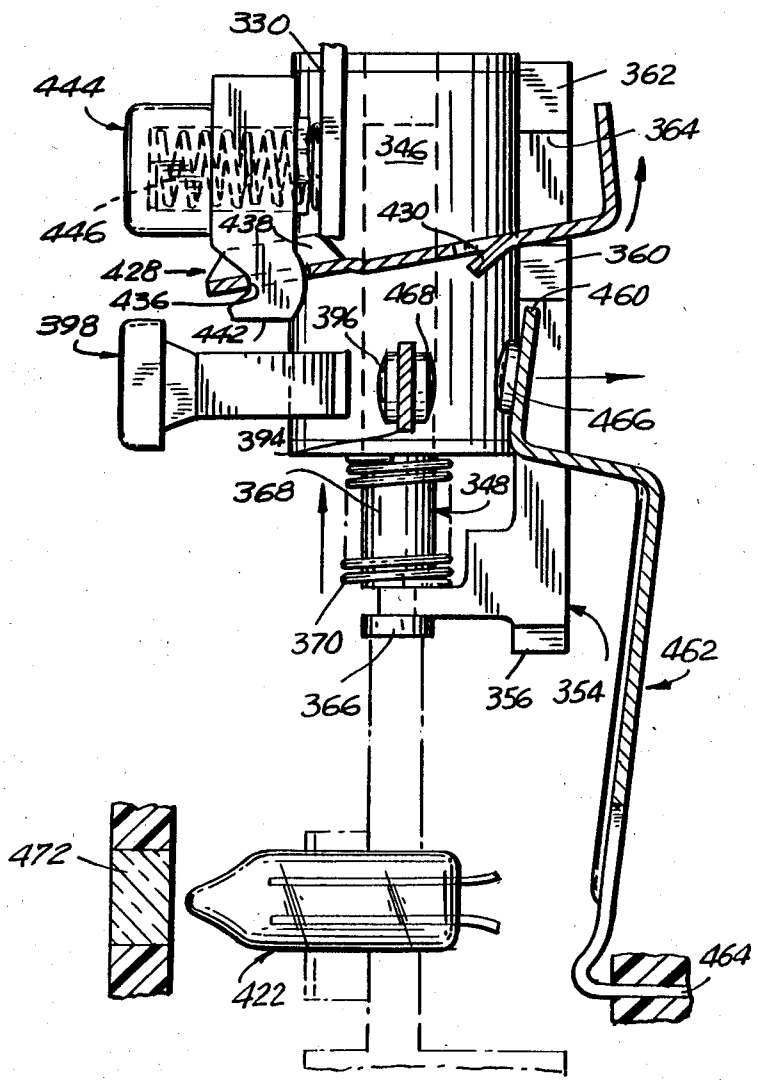
FIGS. 6 and 7 are enlarged views of a portion of the latching mechanism.

Upon the occurrence of a "fault" condition, which is predetermined, a signal is received by the electronic circuitry associated with system 310 but which is not part of the invention being presently claimed hereby, with the result that coil assembly 346 is energized. The energization of coil 346 results in the generation of a magnetic field therearound with the aid of mounting strap 326, with the further result that plunger 348 is forcibly drawn toward coil 346. FIGS. 6 and 7 illustrate the disposition of latching members 426 and 428 at portions 464 between front and rear banger dogs 360 and 362 within their respective gaps 364 described above.

Upon energization of coil 346 and the forcible movement of plunger 348 toward the coil and against the compressive forces of banger return spring 370, the banger is thus to likewise move, with the result that rear banger dogs 362 "bang" or hit against latching member portions 470, dislodging latching fingers 430 from engagement with the undersides of ends 460 of the movable contacts as a result of rearward pivotal movement of the latching members, with the further result that the movable contact arms 462 swing downwardly under spring pressure such that the movable and fixed contacts are separated, thereby "breaking" or interrupting the normally closed operating circuit. The circuit remains open until reset by means of the reset button 444 in the manner already described.

It should also be pointed out here that portions 464 of latching members 426 and 428 are maintained in forward contact with ends 460 by means of the compressive forces within banger return spring 370 acting through rear banger dogs 362. It is this constant contact that enables reliable resetting by means of the latching fingers. FIGS. 6 and 7 also illustrate optional diode 422 in its energized and non-energized states, with optional window 472 provided to enable the user to see the lit diode during depression of the test button 398.

Figure 9:
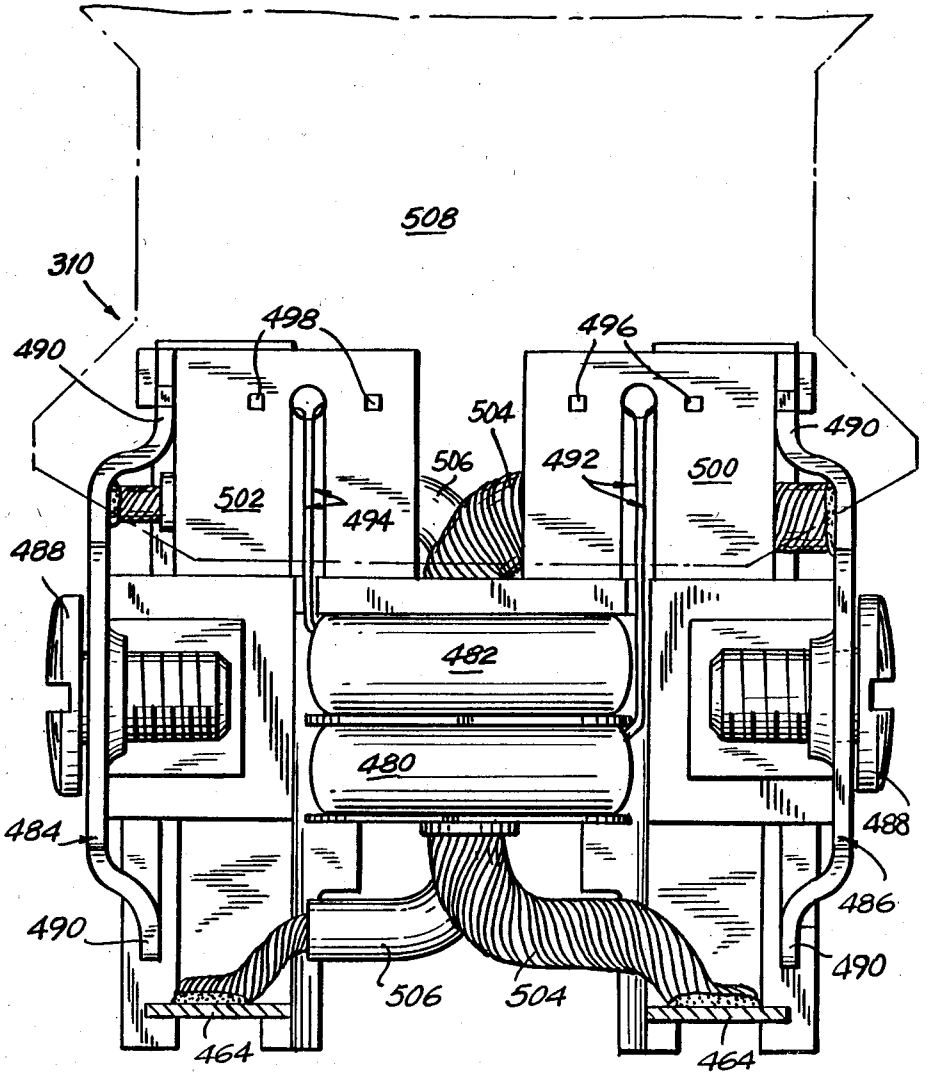
FIG. 9 is a sectional view taken along line 9—9 of FIG. 3.

FIG. 9 illustrates system 310 in a bottom plan view, relatively speaking, looking at the exposed inner portions of central housing portion 314 with rear housing portion 318 removed. A differential transformer 480 and a neutral transformer 482 are located adjacent one one another along a common axis and between terminals 484 and 486 on either side of system 310. Terminals 484 and 486 are equipped with terminal screws 488 and are formed with outwardly extending flanges 490 on either side of each which serve to anchor the terminals within housing slots. Leads 492 and 494 extend, respectively, from transformers 480 and 482 to pairs 496 and 498 of wiring posts within transformer brackets 500 and 502. Conductors 504 and 506 are welded (soldered) to and between anchor legs 464 of the movable contact arms 462 and terminals 484 and 486. Resistor 424 is connected between terminal 486 and anchor leg 416 of test switch blade 414. A circuit board 508 is illustrated in broken or phantom lines within FIG. 9, and is electrically interconnected to terminals 484 and 486 by means of posts 510 formed as part of the terminals.

A depending mounting strap tab 512 is illustrated in FIG. 10 as having threaded thereto a wire binding screw 514 for purposes of attaching a wire ground connection where appropriate.

The embodiments of the present invention herein described and disclosed are presented merely as examples of the invention. Other embodiments, forms and structures coming within the scope of the present invention will readily suggest themselves to those skilled in the art, and shall be deemed to come within the scope of the appended claims.

What is claimed is:

1. Switching apparatus for selectively interrupting an electrical connection between input and output conductors, or the like, comprising, in combination: a housing; magnetizable plunger means disposed within a portion of said housing for movement between first and said housing for moving said plunger means when energized from the first position to the second position; an input contact electrically connected to said input conductor; an output contact electrically connected to said output conductor; strap means for mounting the switching apparatus upon a selected surface, said strap means including portions thereof which define a path of the magnetic field generated by said coil means to influence the position of said plunger means, and movable means responsive to movement of said plunger means for influencing a separation of said input and output contacts, thereby interrupting electrical connection between them, said movable means including first and second movable members, movement of said second member being caused by movement of said first member.

2. Switching apparatus according to claim 1, wherein said first member is movable with and opperatively connected to said plunger means.

3. Switching apparatus according to claim 1, wherein said plunger means comprises a plunger member formed with a relatively elongated portion which extends into portions of said electromagnetic coil means.

4. Switching apparatus according to claim 1, further including spring means for returning said plunger means to said first position after energization of said coil means.

* * * * *

UNITED STATES PATENT AND TRADEMARK OFFICE

CERTIFICATE OF CORRECTION

PATENT NO. : 4,595,894

DATED : June 17, 1986

INVENTOR(S) : Richard C. Doyle, et al

It is certified that error appears in the above-identified patent and that said Letters Patent is hereby corrected as shown below:

Column 7, line 3, Claim 2, after "and" should read --second positions; electromagnet coil means disposed within--.

Signed and Sealed this

Twelfth Day of July, 1988

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,595,894
DATED : June 17, 1986
INVENTOR(S) : Richard C. Doyle, et al.

It is certified that error appears in the above-identified patent and that said Letters Patent is hereby corrected as shown below:

Column 6, claim 1,
Line 53, after "and" should read -- second positions; electromagnet coil means disposed within --.

This Certificate supersedes Certificate of Correction issued July 12, 1988.

Signed and Sealed this

Eleventh Day of December, 2001

*Attest:*

Nicholas P. Godici

*Attesting Officer*

NICHOLAS P. GODICI
*Acting Director of the United States Patent and Trademark Office*